US005338439A

United States Patent [19]

Owen et al.

[11] Patent Number: 5,338,439

[45] Date of Patent: Aug. 16, 1994

[54] PROCESS AND APPARATUS FOR REGENERATION OF FCC CATALYST WITH REDUCED NOX AND OR DUST EMISSIONS

[75] Inventors: Hartley Owen, Belle Mead, N.J.; Paul H. Schipper, Wilmington, Del.

[73] Assignee: Mobil Oil Corporation, Fairfax, Va.

[21] Appl. No.: 963,353

[22] Filed: Oct. 20, 1992

[51] Int. Cl.[5] ..... C10G 11/00

[52] U.S. Cl. ..... 208/153; 208/113; 208/155; 208/163; 208/164

[58] Field of Search ..... 208/113, 153, 155, 163, 208/164

[56] References Cited

U.S. PATENT DOCUMENTS

| | | | |
|---|---|---|---|
| 3,953,175 | 4/1976 | Pulak | 208/164 |
| 4,849,091 | 7/1989 | Cabrera et al. | 208/155 |
| 5,047,140 | 9/1991 | Owen et al. | 208/113 |

*Primary Examiner*—Helane Myers
*Assistant Examiner*—Walter D. Griffin
*Attorney, Agent, or Firm*—Alexander J. McKillop; Malcolm D. Keen; Richard D. Stone

[57] ABSTRACT

A process and apparatus for increasing the coke burning capacity of FCC catalyst regenerators is disclosed. An auxiliary regenerator receives spent catalyst from an FCC stripper and burns some of the coke at turbulent or fast fluidized bed conditions. Partially regenerated catalyst and flue gas enter a low pressure drop cyclone discharging more than 90% of the partially regenerated catalyst down into a bubbling or fast fluidized bed in the primary regenerator. Flue gas from the auxiliary regenerator is discharged into the dilute phase above the bed in the primary regenerator. Catalyst entrainment from the fluidized bed in the primary regenerator may be reduced because less combustion air is needed as a result of partial regeneration in the auxiliary regenerator. Reduced NOx and dust emissions, and/or increased coke burning capacity, may be achieved, especially when a bubbling dense bed primary catalyst regenerator is used.

6 Claims, 3 Drawing Sheets

PROCESS AND APPARATUS FOR REGENERATION OF FCC CATALYST WITH REDUCED NOX AND OR DUST EMISSIONS

BACKGROUND OF THE INVENTION

1. FIELD OF THE INVENTION

The invention relates to a process and apparatus for the regeneration of fluidized catalytic cracking catalyst.

2. DESCRIPTION OF RELATED ART

In the fluidized catalytic cracking (FCC) process, catalyst, having a particle size and color resembling table salt and pepper, circulates between a cracking reactor and a catalyst regenerator. In the reactor, hydrocarbon feed contacts a source of hot, regenerated catalyst. The hot catalyst vaporizes and cracks the feed at 425° C.–600° C., usually 460° C.–560° C. The cracking reaction deposits carbonaceous hydrocarbons or coke on the catalyst, thereby deactivating the catalyst. The cracked products are separated from the coked catalyst. The coked catalyst is stripped of volatiles, usually with steam, in a catalyst stripper and the stripped catalyst is then regenerated. The catalyst regenerator burns coke from the catalyst with oxygen containing gas, usually air. Decoking restores catalyst activity and simultaneously heats the catalyst to, e.g., 500° C.–900° C., usually 600° C.–750° C. This heated catalyst is recycled to the cracking reactor to crack more fresh feed. Flue gas formed by burning coke in the regenerator may be treated for removal of particulates and for conversion of carbon monoxide, after which the flue gas is normally discharged into the atmosphere.

Catalytic cracking has undergone progressive development since the 40s. The trend of development of the fluid catalytic cracking (FCC) process has been to all riser cracking and use of zeolite catalysts. A good overview of the importance of the FCC process, and its continuous advancement, is reported in Fluid Catalytic Cracking Report, Amos A. Avidan, Michael Edwards and Hartley Owen, as reported in the Jan. 8, 1990 edition of the *Oil & Gas Journal.*

Modern catalytic cracking units use active zeolite catalyst to crack the heavy hydrocarbon feed to lighter, more valuable products. Instead of dense bed cracking, with a hydrocarbon residence time of 20–60 seconds, much less contact time is needed. The desired conversion of feed can now be achieved in much less time, and more selectively, in a dilute phase, riser reactor.

There has been considerable evolution in the design of FCC units, which evolution is reported to a limited extent in the Jan. 8, 1990 *Oil & Gas Journal* article. Many FCC regenerator designs are used, most of which involve bubbling dense bed regenerators. There are two generic types of regenerators: high efficiency units, operating with a fast fluidized bed and bubbling dense bed units. Three species have evolved of bubbling dense bed units:

1. Cross-flow
2. Swirl
3. Orthoflow.

The cross-flow and swirl regenerators have severe NOx problems and capacity. The NOx and capacity problems are an inherent by-product of bubbling fluidized bed operation. Large amounts of regeneration gas bypass the fluidized bed in the form of large bubbles. There are localized high oxygen concentrations, and any nitrogen containing coke burned there forms NOx. Much CO is produced from oxygen starved regions of the bed, and this CO mixes with the oxygen rich bubbles to cause afterburning in dilute phase regions of the bed. Additional amounts of NOx can form in the dilute phase, especially when afterburning is severe. In addition, the beds are made so large, due to inefficient contacting of gas and solids, that some portions of the bed are stagnant so much of the bed remains for too long in the regenerator and discharges oxygen rich flue gas into the dilute phase region.

The cross-flow regenerators have similar problems, but usually form somewhat less NOx than swirl regenerators.

Both swirl and cross-flow regenerators do a good job at retaining catalyst and fines. This is fairly easy to do in such regenerators, because the relatively low superficial vapor velocities (which promote formation of undesired large bubbles in the dense bed) do not entrain catalyst as much as the higher superficial vapor velocities used in high efficiency regenerators.

The problems of poor flow in the dense bed of swirl and cross-flow regenerators can be largely solved by putting in baffles, or multiple inlets or outlets, as taught in U.S. Pat. Nos. 4,980,048 (cross-flow), 4,994,424 (swirl) incorporated by reference.

These units still produce more NOx than desired, and attempts at increasing capacity, by blowing more air in them, increase the dilute phase traffic sufficiently to cause a dust emissions problems in some units.

The Kellogg Ultra Orthoflow converter, Model F, shown in FIG. 1 of this patent application, and also shown as FIG. 17 of the Jan. 8, 1990 *Oil & Gas Journal* article discussed above, has a large, bubbling dense bed regenerator with few stagnant regions, as catalyst is added and dispersed through a centrally located catalyst standpipe.

These units, like the other bubbling dense bed regenerators discussed above, cannot easily tolerate more combustion air without increasing dilute phase catalyst traffic. We recently suggested a way to achieve the benefits of FFB coke combustion, while retaining most of the original design. We were able, in predecessor applications (one of which is now U.S. Pat. No. 5,047,140, incorporated by reference) to obtain some improvements in this design with a side mounted fast fluidized bed coke combustor, which discharged catalyst into an annular region about the stripper catalyst standpipe. The '140 patent permitted an increase in regenerator duty, without a proportionate increase in superficial vapor velocity in the bubbling dense bed, but our approach required considerably mechanical modification of the unit to provide an annular return region about the stripper catalyst standpipe and relied on an increase in catalyst traffic near the stripper standpipe to increase the heat transfer coefficient. Although preheating of spent catalyst in the stripper standpipe is beneficial, the design would increase dilute phase catalyst traffic. The separator design shown recovered only "a majority of the catalyst . . ." and would thus increase particulate loading in the dilute phase. We wanted a lower cost way to increase the regeneration capacity of these Orthoflow units.

The bubbling bed regenerators discussed above all generally size the cyclones and the regenerator vessel to deal with catalyst entrainment expected from a given superficial vapor velocity through the bubbling dense bed. Not all regenerators are limited to dense bed regeneration, and these fast fluidized bed regenerators will be reviewed next.

High efficiency regenerators inherently make less NOx than bubbling bed regenerators, but even these may make more NOx than desired. These regenerators also present special problems, in that increases in superficial vapor velocity in the regenerator may remove more inventory than desired from the fast fluidized bed coke combustor. Thus, attempts to increase the capacity of these units by increasing air flow to the coke combustor can reduce residence time of spent catalyst in the coke combustor. This can be offset by increased catalyst recycle to the coke combustor from the second dense bed, but increased catalyst recycle leads to increased catalyst traffic and increased dust emissions, and some of these units may have difficulty complying with strict local limits on particulates.

Local limits on particulates emissions can be so severe, and operation so sensitive to regenerator superficial vapor velocity, that particulates emissions can limit throughput.

One refiner, with a high efficiency regenerator, recently reported on use of oxygen enrichment to reduce vapor velocity. Liquid oxygen was vaporized by passing through a cooling tower, then mixed with air from the air blower. "See O2 enrichment increases FCC operating flexibility," OGJ, May 11, 1992, p. 40. Other refiners have resorted to oxygen addition in the past, usually to overcome air blower limitations, but sometimes to deal with velocity limitations.

To summarize, the current regenerator designs can be arbitrarily classified as relying on either a bubbling dense bed or a fast fluidized bed for regeneration. Some hybrid approaches exist which are reviewed hereafter. This should not be construed as an exhaustive search of hybrid regenerators, but rather as a representative sampling.

U.S. Pat. No. 3,821,103, Owen, discloses in FIG. II a bubbling bed regenerator with a riser regenerator 62 passing up through a bubbling dense bed 78 and terminating in a riser cyclone 70. Catalyst regeneration then continued in the bubbling dense bed. The two flue gas streams were kept isolated. The sulfur rich coke was burned in the riser regenerator, and the sulfur rich flue gas removed via conduit 82, while dense bed flue gas was removed via conduit 98. Such an approach would not add to the dilute phase catalyst loading above dense bed region 78, as no gas or entrained catalyst from the riser regenerator entered the dilute phase region. While the approach is certainly valid, it requires considerable capital expenditure to implement this, and can not be readily retrofit into existing regenerators.

U.S. Pat. No. 3,866,060, Owen, discloses in FIG. II a relatively dilute phase zone 63 operating within a regenerator vessel containing a bubbling fluidized bed of catalyst disposed as an annulus about zone 63. The Figure also shows that catalyst entrainment in the dilute phase region is greatly increased by this approach.

It is believed that most hybrid approaches follow similar paths, i.e., combinations of high superficial vapor velocity regeneration and bubbling bed regeneration either lead to increased catalyst traffic or require considerable capital expense or both.

We recognized the need for a better regenerator design, one which would increase the coke burning capacity of regenerators without proportionately increasing dust emissions, and without requiring undue capital expense.

We discovered a way to increase coke burning capacity of bubbling dense bed regenerators without proportionately increasing dense bed catalyst entrainments. We were even able to reduce NOx emissions, while increasing coke burning.

As applied to high efficiency regenerators, we could increase the amount of coke, especially of nitrogenous coke, burned in an oxidizing atmosphere upstream of the dilute phase transport riser, without appreciable shrinkage of spent catalyst residence time in the coke combustor.

BRIEF SUMMARY OF THE INVENTION

Accordingly, the present invention provides a process for the fluidized catalytic cracking of a heavy feed to lighter products, and multi-stage regeneration of catalyst in both a fast fluidized bed auxiliary regenerator and a bubbling dense bed regenerator, comprising: cracking said heavy feed in a vertical riser reactor having an inlet in a lower portion thereof for said feed and for a stream of regenerated cracking catalyst from a bubbling, dense phase fluidized bed of catalyst in a primary catalyst regenerator vessel, said reactor having an outlet in an upper portion thereof for discharging a mixture of spent cracking catalyst and cracked products into a reactor vessel; separating, in said reactor vessel, cracked vapor products from spent catalyst discharged from said riser reactor to produce a cracked vapor product stream which is removed and a spent catalyst stream; stripping said spent catalyst stream in a catalyst stripping means having an inlet for spent catalyst from said reactor vessel, an inlet for stripping gas in a lower portion, and an outlet in a lower portion for stripped catalyst; transferring stripped catalyst from said stripping means to an auxiliary regenerator vessel; turbulent or fast fluidized bed regeneration of said stripped catalyst from said stripping means by contact with an oxygen containing regeneration gas in an auxiliary regenerator vessel external to, and along side of, said primary regenerator vessel, said auxiliary regenerator having: an inlet for stripped catalyst: an inlet in a lower portion for regeneration gas; and an outlet in an upper portion thereof for partially regenerated catalyst and flue gas; transferring said partially regenerated catalyst and flue gas from said auxiliary regenerator to said primary regenerator vessel via a transfer line having an inlet connective with said auxiliary regenerator outlet and a horizontal outlet in said primary regenerator vessel connective with at least one auxiliary cyclone; cyclonically separating in said auxiliary cyclone at least 85% of said partially regenerated catalyst from flue gas in said primary regenerator vessel, said auxiliary cyclone having: a tangential inlet horn connective with said horizontal outlet of said transfer line; a vertical vapor outlet extending up from said cyclone into a dilute phase region of said primary regenerator vessel; a vertical solids outlet dipleg extending down into a bubbling dense bed region of said primary regenerator vessel; and discharging down into said bubbling dense bed a solids rich stream of partially regenerated catalyst via said dipleg outlet and discharging up a flue gas rich dilute phase via said cyclone vapor outlet; bubbling dense bed regeneration of said partially regenerated catalyst in said primary regenerator vessel, said vessel having: an inlet in a lower portion thereof, and within said bubbling fluidized bed, for oxygen containing regeneration gas; an outlet within said bubbling fluidized bed for removal of regenerated catalyst; a dilute phase region above said bubbling dense bed for bubbling dense bed flue gas and entrained catalyst; combining in said dilute phase region of said primary regenerator vessel flue gas and entrained regenerated catalyst from said bubbling dense bed and flue gas discharged via said cyclone vapor outlet to produce a combined flue gas stream containing: entrained regenerated catalyst from said bubbling dense bed; entrained partially regenerated catalyst from said auxiliary regenerator; and flue gas from said auxiliary regenerator and said bubbling dense bed; and cyclonically separating said entrained catalyst from said combined flue gas stream by passing said combined flue gas stream through a plurality of regenerator primary cyclones having cyclone inlets in said dilute phase region in said primary regenerator vessel to produce a combined flue gas stream with a reduced catalyst and fines content and a recovered catalyst stream which is returned to said bubbling dense bed via a plurality of primary cyclone diplegs.

In another embodiment, especially suited for use with a high efficiency regenerator, the present invention provides a process for the fluidized catalytic cracking of a heavy feed to lighter products, and multi-stage regeneration of catalyst in a fast fluidized bed auxiliary regenerator and a fast fluidized bed coke combustor, comprising: cracking said heavy feed in a vertical riser reactor having an inlet in a lower portion thereof for said feed and for a stream of regenerated cracking catalyst from a bubbling, dense phase fluidized bed of catalyst in a primary catalyst regenerator vessel, said reactor having an outlet in an upper portion thereof for discharging a mixture of spent cracking catalyst and cracked products into a reactor vessel; separating, in said reactor vessel, cracked vapor products from spent catalyst discharged from said riser reactor to produce a cracked vapor product stream which is removed and a spent catalyst stream; stripping said spent catalyst stream in a catalyst stripping means having an inlet for spent catalyst from said reactor vessel, an inlet for stripping gas in a lower portion, and an outlet in a lower portion for stripped catalyst; transferring stripped catalyst from said stripping means to an auxiliary regenerator vessel; turbulent or fast fluidized bed regeneration of said stripped catalyst from said stripping means by contact with an oxygen containing regeneration gas in an auxiliary regenerator vessel external to, and along side of, said primary regenerator vessel, said auxiliary regenerator having: an inlet for stripped catalyst: an inlet in a lower portion for regeneration gas; and an outlet in an upper portion thereof for partially regenerated catalyst and flue gas; and said primary regenerator vessel having: a fast fluidized bed coke combustor having an inlet for spent catalyst and an inlet for regeneration gas; a dilute phase transport riser in an upper portion of said coke combustor for transferring a dilute phase mixture of catalyst and flue gas up from said coke combustor to a riser outlet at a top portion of said transport riser; and a regenerator vessel for holding a dense bed of regenerated catalyst receiving catalyst and flue gas discharged from said transport riser, and having in a lower portion of said vessel a regenerated catalyst outlet for transfer of regenerated catalyst to said cracking reactor; transferring said partially regenerated catalyst and flue gas from said auxiliary regenerator to said coke combustor via a transfer line having an inlet connective with said auxiliary regenerator outlet and a horizontal outlet in said coke combustor connective with at least one auxiliary cyclone; cyclonically separating in said auxiliary cyclone at least 85% of said partially regenerated catalyst from flue gas in said coke combustor, said auxiliary cyclone having: a tangential inlet horn connective with said horizontal outlet of said transfer line; a vertical vapor outlet extending up from said cyclone toward said dilute phase transport riser; a vertical solids outlet dipleg extending down into said coke combustor; and discharging down into said coke combustor a solids rich stream of partially regenerated catalyst via said dipleg outlet and discharging up toward an inlet of said transport riser a flue gas rich dilute phase via said cyclone vapor outlet; fast fluidized bed regeneration of said partially regenerated catalyst in said coke combustor; combining in said dilute phase transport riser all catalyst and all flue gas discharged from said coke combustor, and discharging from said transport riser cyclone outlet said combined stream into said primary regenerator vessel and separating said discharged combined stream to produce a flue gas stream which is withdrawn from said vessel and a regenerated catalyst stream which is returned to said cracking reactor.

In an apparatus embodiment, the present invention provides an apparatus for multi-stage fast fluidized bed and bubbling fluidized bed regeneration of fluidized catalytic cracking catalyst comprising: a vertical, cylindrical catalyst first regenerator vessel having a vertical axis and an outlet for regenerated catalyst in a lower $\frac{1}{3}$ portion thereof, an outlet for regenerator flue gas in an upper $\frac{1}{3}$ portion thereof, and an inlet for regeneration gas in a lower $\frac{1}{3}$ portion thereof; a regenerated catalyst transfer means for transfer of regenerated catalyst from said first regenerator to a cracking reactor; a catalyst stripping means receiving catalyst discharged from said reactor and having an outlet for stripped catalyst; a stripped catalyst transfer means for transferring stripped catalyst from said stripper to an auxiliary regenerator vessel; said auxiliary regenerator vessel having: an inlet for stripped catalyst connective with said spent catalyst transfer means; an inlet in a lower portion for regeneration gas; and an outlet in an upper portion thereof for partially regenerated catalyst and flue gas; an auxiliary regenerator flue gas and catalyst transfer line receiving partially regenerated catalyst and flue gas discharged from said auxiliary regenerator outlet and discharging same via a horizontal outlet into said first regenerator vessel; and a cyclone separator within said first regenerator vessel having: a tangential inlet horn connective with said horizontal outlet; a vertical vapor outlet for flue gas from said auxiliary regenerator vessel extending up from said cyclone and above said regenerated catalyst outlet of said primary regenerator vessel; a vertical solids outlet for partially regenerated catalyst from said auxiliary regenerator vessel comprising a dipleg extending down into said lower $\frac{1}{3}$ portion of said primary regenerator vessel.

DESCRIPTION OF PREFERRED EMBODIMENTS

Figure 1:
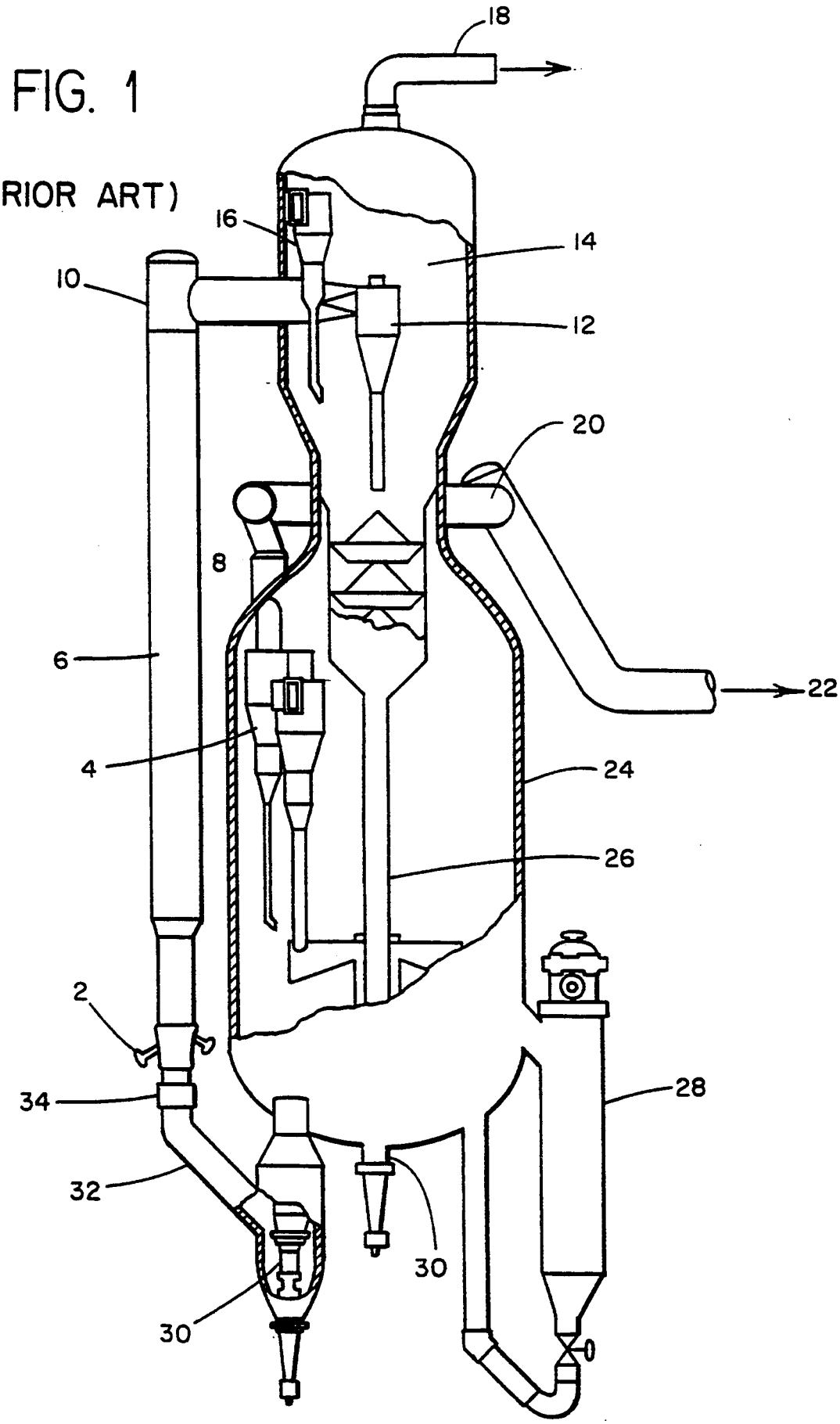
FIG. 1 (PRIOR ART)
FIG. 1 (prior art) is a schematic view of a conventional "Orthoflow" fluidized catalytic cracking unit.

FIG. 1 is a simplified schematic view of an FCC unit of the prior art, similar to the Kellogg Ultra Orthoflow converter Model F shown as FIG. 17 of Fluid Catalytic Cracking Report, in the Jan. 8, 1990 edition of *Oil & Gas Journal.*

A heavy feed such as a gas oil, vacuum gas oil is added to riser reactor 6 via feed injection nozzles 2. The cracking reaction is completed in the riser reactor, which takes a 90° turn at the top of the reactor at elbow 10. Spent catalyst and cracked products discharged from the riser reactor pass through riser cyclones 12 which efficiently separate most of the spent catalyst from cracked product. Cracked product is discharged into disengager 14 and eventually is removed via upper cyclones 16 and conduit 18 to the fractionator.

Spent catalyst is discharged down from a dipleg of riser cyclones 12 into catalyst stripper 8 where one, or preferably 2 or more, stages of steam stripping occur, with stripping steam admitted by means not shown in the figure. The stripped hydrocarbons, and stripping steam, pass into disengager 14 and are removed with cracked products after passage through upper cyclones 16.

Stripped catalyst is discharged down via spent catalyst standpipe 26 into catalyst regenerator 24. The flow of catalyst is controlled with spent catalyst plug valve 36.

Catalyst is regenerated in regenerator 24 by contact with air, added via air lines and an air grid distributor not shown. A catalyst cooler 28 is provided so heat may be removed from the regenerator, if desired. Regenerated catalyst is withdrawn from the regenertor via regenerated catalyst plug valve assembly 30 and discharged via lateral 32 into the base of the riser reactor 6 to contact and crack fresh feed injected via injectors 2, as previously discussed. Flue gas, and some entrained catalyst, are discharged into a dilute phase region in the upper portion of regenerator 24. Entrained catalyst is separated from flue gas in multiple stages of cyclones 4, and discharged via outlets 8 into plenum 20 for discharge to the flare via line 22.

Figure 2:
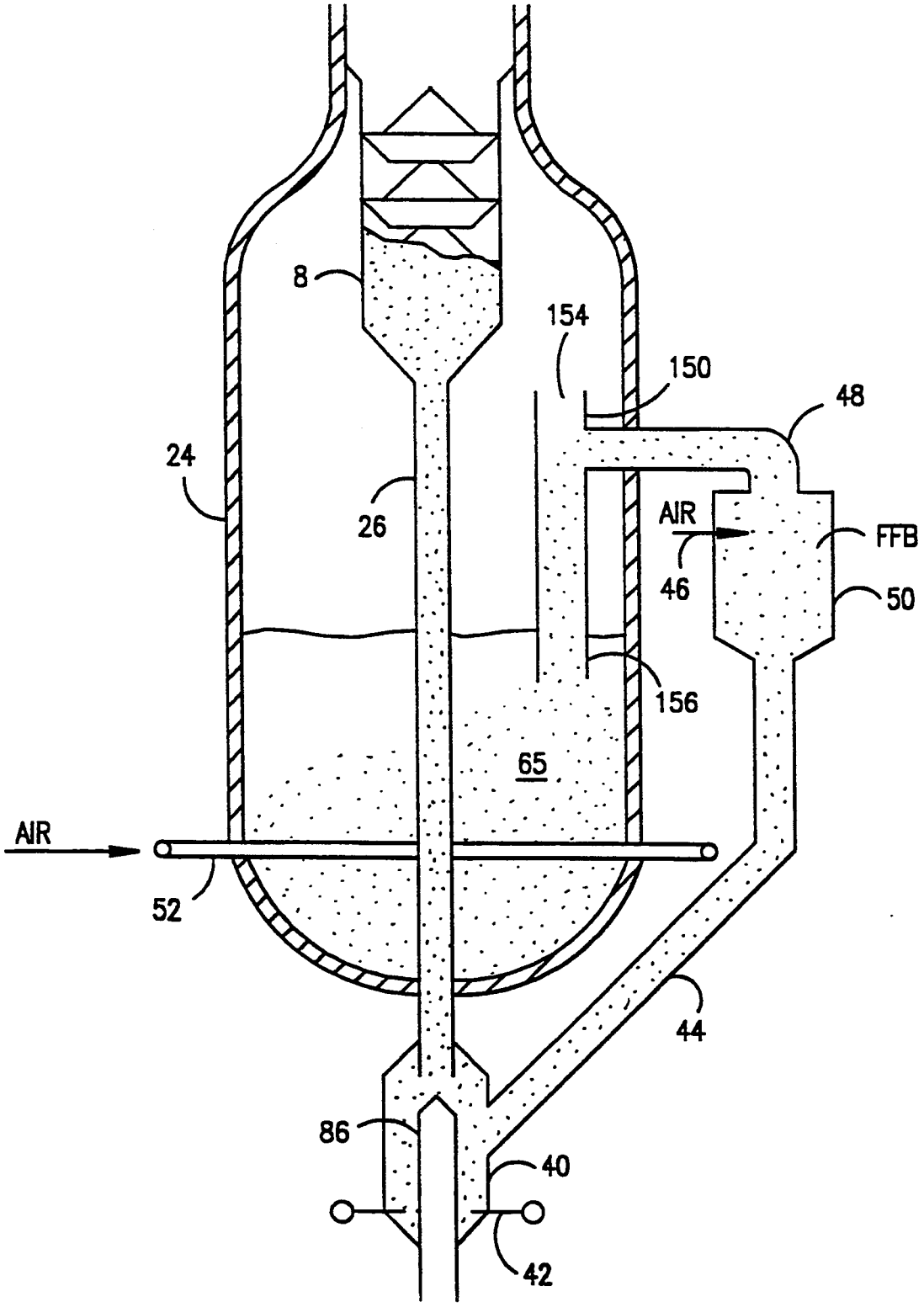
FIG. 2 (invention) is a schematic view of a bubbling bed regenerator of the invention, with a low dust auxiliary regenerator discharging into the vessel containing the bubbling dense bed, in an "Orthoflow" design.

In FIG. 2 (invention) only the changes made to the old regenerator shell 24 are shown. Like elements in FIG. 1 and 2 have like numerals.

FIG. 2 is similar to FIG. 2 of U.S. Pat. No. 5,047,140. The difference is use of a low pressure drop cyclone to reduce dust emissions. Our low pressure drop cyclone will not heat the stripper standpipe, while the annular heat exchanger arrangement shown in '140, will not reduce dust emissions as much as our low pressure drop cyclone.

A high efficiency regenerator pod or auxiliary regenerator 50 is added to the side of the old regenerator vessel 24. Stripped catalyst from the catalyst stripper 8 is discharged via stripper dipleg 26 down into transport pot 40. The flow of catalyst into the transport pot 40 may be controlled by a plug valve 86, as shown, or the pot 40 may be located a sufficient distance below regenerator 24 to permit installation of a slide valve to control catalyst flow. Spent catalyst dumped into pot 40 is fluidized, and combustion is started, by adding combustion air via line 42. The catalyst is transported via line 44 into side mounted, fast fluidized bed region 50. Preferably additional combustion air is added via line 46. Auxiliary regenerator, or pod 50 is preferably sized to maintain the catalyst in a highly turbulent state, also called a fast fluidized bed, although somewhat lower velocities can be used too. There should be at least fast fluidized bed flow in vessel 50. This requires a superficial vapor velocity above 3 fps, usually at least about 4 or 5 feet per second, and preferably 5–15 feet per second. The catalyst density in a majority of the volume in the coke combustor will usually be less than 35 pounds/cubic foot, and preferably less than 30 pounds/cubic foot, and ideally about 25 pounds/cubic foot. Enough air should be added, via line 42 and/or line 46 to burn 20–90% of the coke on the spent catalyst, and preferably 40 to 85% of the coke. At least partially regenerated catalyst and flue gas will be discharged via line 48 into regenerator vessel 24. Flow through line 48 will be relatively dilute phase, because of the high vapor velocities involved, usually in the region of 15–50 feet per second.

The auxiliary regenerator works best with the bubbling dense bed (or other) regenerator when it does a significant amount of regeneration, but does not try to completely regenerate the catalyst. Usually the auxiliary regenerator will be run to remove from 10 to 90% of the delta coke on catalyst, and preferably from 20 to 85% of the delta coke, and most preferably from 25 to 75% of the delta coke. By delta coke we mean the differential between coke on regenerated catalyst and coke on spent catalyst.

The partially regenerated catalyst is discharged into the relatively dilute phase atmosphere above the bubbling dense bed of catalyst in regenerator vessel 24 via low pressure drop cyclone 150. Cyclone 150 has a tangential inlet 152 connected with transfer line 148, an upper vapor outlet 154, and a solids outlet or dipleg 156, sealed by immersion in the bubbling dense bed of catalyst in vessel 24. In most stacked units of this type (Orthoflow), vessel 24 could be considered in thirds, with the lower one third of the vessel containing the bubbling dense bed of catalyst, the upper $\frac{1}{3}$ containing the inlet horns of the cyclones, with swings in dense bed level, and disengaging space, taken in the middle $\frac{1}{3}$ of the vessel. Usually, the cyclone dipleg must connect with the lower $\frac{1}{3}$ of the vessel to provide an adequate seal, while the vapor outlet must be located well above the mid point of the vessel, and preferably above the $\frac{2}{3}$ point of the vessel, to minimize entrainment of catalyst from the bubbling dense bed into the dilute phase region.

The low pressure drop cyclone vapor outlet will add a lot of catalyst traffic to the dilute phase region, that is inherent in use of a low pressure drop cyclone; the efficiency can range from perhaps as low as around 85–97% but usually will be at least 90–95% efficient at recovering catalyst. At first this might seem to increase dilute phase traffic, and increase dust emissions, but in practice the reverse will occur. The slight increase in dilute phase catalyst traffic from the low pressure drop cyclone is more than offset by a sharp reduction in catalyst entrainment from the bubbling dense bed. Less combustion air is needed in the bubbling dense bed, and the reduced superficial vapor velocity reduces catalyst entrainment from the dense bed into the dilute phase. Overall, catalyst traffic in the dilute phase entering the cyclones 4 is reduced, and this reduces the amount of catalyst and fines discharged via line 22 to the stack.

It may be beneficial to recycle hot regenerated catalyst from bed 65 to transport pot 40 by means not shown. It may be beneficial to provide catalyst coolers to allow heat removal from around the regenerator via conventional catalyst coolers.

Figure 3:
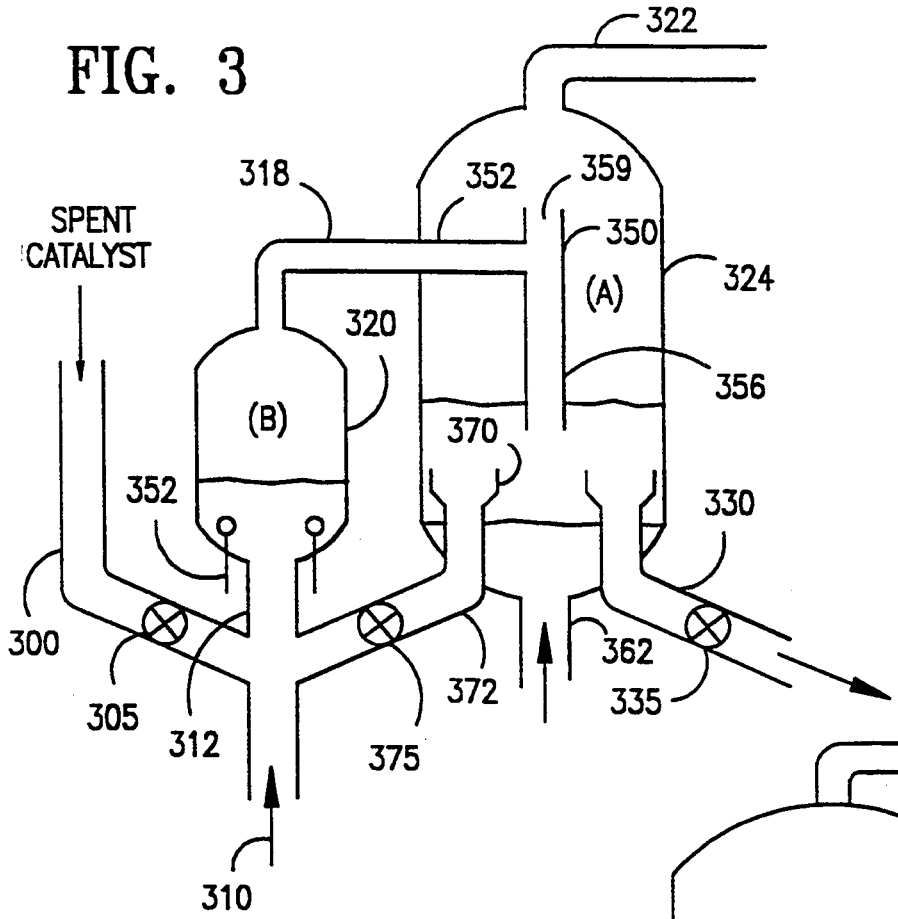
FIG. 3 (invention) is a schematic view of a "side-by-side" regenerator with a low dust auxiliary regenerator discharging into the regenerator vessel.

FIG. 3 is a greatly simplified schematic view of a side-by-side regenerator, modified to include an auxiliary regenerator and low efficiency cyclone. This regenerator would usually be used in conjunction with a side-by-side FCC unit, many of which are shown in the *Oil & Gas Journal* FCC survey article previously discussed.

Spent catalyst from a reactor and catalyst stripper, not shown, are discharged via line 300 and slide valve 305, into the base of riser mixer 312. Spent catalyst mixes with recycled regenerated catalyst from line 372 and is lifted into the auxiliary regenerator 320 with fluidizing and combustion air added via line 310. Additional combustion air is added via air ring distribution means 352. Conditions in vessel 320 are similar to those in vessel 50, in FIG. 2.

Partially regenerated catalyst is discharged from vessel 320 via line 318 into the relatively dilute phase atmosphere above the bubbling dense bed of catalyst in regenerator vessel 324 via low pressure drop cyclone 350. Cyclone 350 has an inlet 352 connected with transfer line 318, an upper vapor outlet 354, and a solids outlet or dipleg 356, sealed by immersion in the bubbling dense bed of catalyst in vessel 324.

Catalyst regeneration is completed in vessel 324 by the addition of more combustion air via air distribution means 362. Flue gas is removed via line 322. Cyclones will be used but are not shown in the Figure.

Regenerated catalyst is withdrawn via line 330 and slide valve 335 for reuse in the reactor means, not shown. Some regenerated catalyst is preferably withdrawn via recycle inlet 370 and charged via line 372 across slide valve 375 to the base of riser mixer 312. This mixing of hot regenerated and relatively cooler spent catalyst rapidly gets temperatures high enough in vessel 320 to promote rapid coke combustion.

Figure 4:
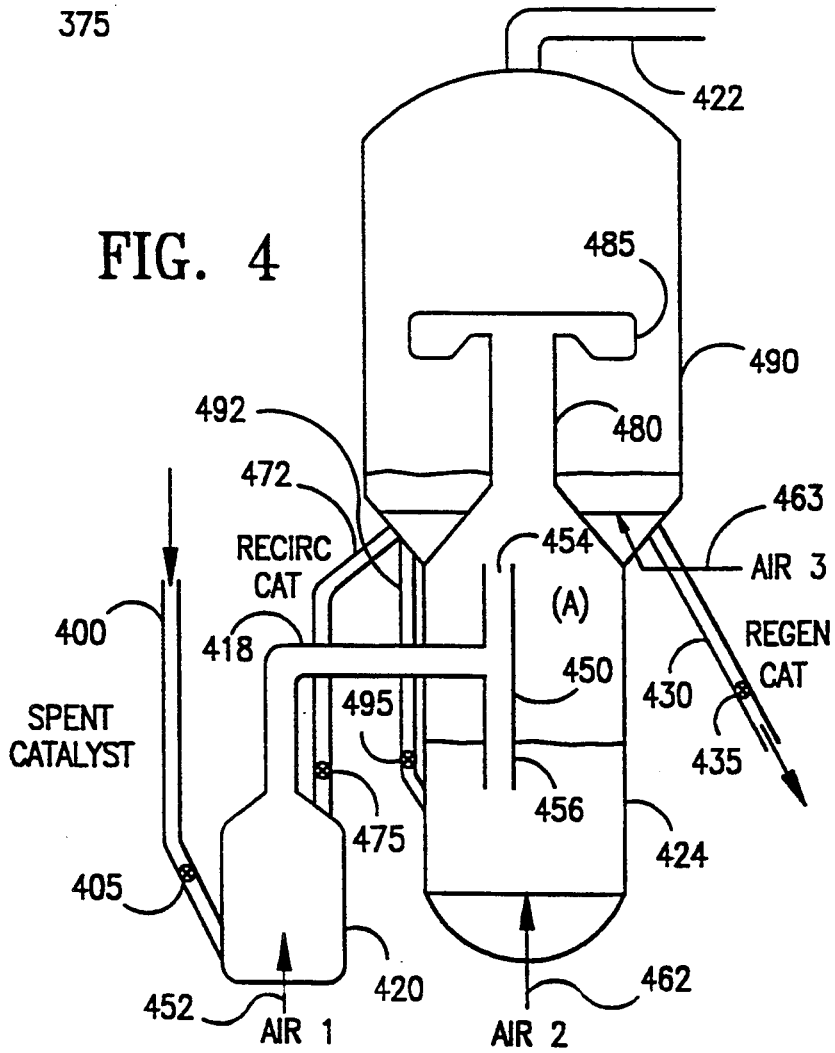
FIG. 4 (invention) is a schematic view of a high efficiency regenerator with a low dust auxiliary regenerator discharging into the vessel containing the bubbling dense bed.

FIG. 4 shows a highly simplified schematic of the process of the present invention as applied to a high efficiency regenerator. The high efficiency regenerator configuration is conventional, but the use of an auxiliary regenerator 420 and low pressure drop cyclone 450 within the coke combustor 424 is not.

Spent catalyst from line 400 passes through slide valve 405 into auxiliary regenerator 420. Combustion air is added via line 452, and preferably some recycle regenerated catalyst is added via line 472 and slide valve 475. Catalyst is partially regenerated in vessel 420, preferably at turbulent or fast fluidized bed regeneration conditions, then discharged via line 418 into low pressure drop cyclone 450. A catalyst lean vapor phase is discharged via vapor outlet 454 while a catalyst rich phase is discharged down via dipleg 456 into the fast fluidized of catalyst maintained in a lower portion of regenerator vessel 424.

Usually most of the catalyst regeneration will be completed in vessel 424, with oxygen containing regeneration gas added via line 462. Catalyst and flue gas are discharged up via dilute phase transport riser 480 into vessel 490. The mixture discharged from transport riser 480 is given a rough stage of separation by using conventional side arm discharge separators 485. Additional stages of cyclone separation will usually be needed but are not shown. A flue gas stream is withdrawn via line 422. A regenerated catalyst phase collects as a bubbling dense bed in the base of vessel 490. Fluffing air, and perhaps some regeneration air, is added to the dense bed via line 463. Regenerated catalyst is removed for reuse in the reactor via line 430 and slide valve 435. Regenerated catalyst may be recycled to the auxiliary regenerator via line 472 and to the coke combustor, vessel 424, via line 492 and slide valve 495.

Although not shown, the process of the present invention may also be used in swirl regenerators.

DESCRIPTION OF PREFERRED EMBODIMENTS

FCC FEED

Any conventional FCC feed can be used. The process of the present invention is especially useful for processing difficult charge stocks, those with high levels of CCR material, exceeding 2, 3, 5 and even 10 wt. % CCR.

The feeds may range from the typical, such as petroleum distillates or residual stocks, either virgin or partially refined, to the atypical, such as coal oils and shale oils. The feed frequently will contain recycled hydrocarbons, such as light and heavy cycle oils which have already been subjected to cracking.

Preferred feeds are gas oils, vacuum gas oils, atmospheric resids, and vacuum resids, and mixtures thereof. The present invention is most useful with feeds having an initial boiling point above about 650° F.

The most uplift in value of the feed will occur when a significant portion of the feed has a boiling point above about 1000° F. or is considered non-distillable, and when one or more heat removal means are provided in the regenerator, as shown in FIG. 1 or in FIG. 3.

FCC CATALYST

Any commercially available FCC catalyst may be used. The catalyst can be 100% amorphous, but preferably includes some zeolite in a porous refractory matrix such as silica-alumina, clay, or the like. The zeolite is usually 5–40 wt. % of the catalyst, with the rest being matrix. Conventional zeolites include X and Y zeolites, with ultra stable, or relatively high silica Y zeolites being preferred. Dealuminized Y (DEAL Y) and ultrahydrophobic Y (UHP Y) zeolites may be used. The zeolites may be stabilized with Rare Earths, e.g., 0.1 to 10 Wt. % RE.

Relatively high silica zeolite containing catalysts are preferred for use in the present invention. They withstand the high temperatures usually associated with complete combustion of CO to CO2 within the FCC regenerator.

The catalyst inventory may also contain one or more additives, either present as separate additive particles, or mixed in with each particle of the cracking catalyst. Additives can be added to enhance octane (shape selective zeolites, i.e., those having a Constraint Index of 1–12, and typified by ZSM-5, and other materials having a similar crystal structure), adsorb SOX (alumina), remove Ni and V (Mg and Ca oxides).

Additives for removal of SOx are available from several catalyst suppliers, such as Davison's "R" or Katalistiks International, Inc.'s "DeSox." CO combustion additives are available from most FCC catalyst vendors.

The FCC catalyst composition, per se, forms no part of the present invention.

ORTHOFLOW CRACKING REACTOR/STRIPPER/REGENERATOR

The FCC reactor, stripper and regenerator shell 24, per se, are conventional and are available from the M.W. Kellogg Company or other vendors.

The modifications needed to add the auxiliary regenerator vessel alongside the conventional regenerator (whether a swirl type, cross-flow, high efficiency, or Orthoflow) are well within the skill of the art.

AUXILIARY REGENERATOR CONDITIONS

Conditions in the auxiliary regenerator, and in the transfer line connecting it to the main regenerator, are very similar to those used in conventional High Efficiency Regenerators (HER) now widely used in FCC units. Typical H.E.R. regenerators are shown in U.S. Pat. Nos. 4,595,567 (Hedrick), 4,822,761 (Walters, Busch and Zandona) and U.S. Pat. No. 4,820,404 (Owen), incorporated by reference.

Auxiliary regeneration temperature will usually range from 1000° to 1500° F., preferably from 1100°-1400° F., with most units operating with temperatures from 1150 to 1275. These are somewhat lower than the temperatures conventionally used in HER coke combustors, but we do not try to achieve complete regeneration in our auxiliary regenerator. We can, by recycling more and more regenerated catalyst, increase temperatures to any desired level, and approach the temperature of the regenerated catalyst, but this requires wasteful amounts of catalyst recycle, increases catalyst traffic, and the higher temperatures will increase NOx emissions.

The conditions in the auxiliary regenerator will usually include a turbulent or fast fluidized bed region in the base, and approach dilute phase flow in the upper regions thereof. Superficial vapor velocities will thus usually be at least 3.0 fps, and typically above 4.0 fps, and preferably range from 5 to 15 fps, more preferably from 5.5 to 12.5 fps, and most preferably from 6 to 12 fps.

These conditions are conventional, what is unconventional is achieving fast fluidized bed catalyst regeneration in an auxiliary regenerator which discharges into the main regenerator, in the dilute phase region thereof, via a low pressure drop cyclone.

LOW PRESSURE DROP CYCLONE

The important design parameters of the low pressure drop cyclone include tangential entry (causing gas and solids to swirl) and that the outlet tube D<inlet horn.

Low pressure drop cyclones are conventional devices, and further description thereof is not necessary. Such devices are commercially available from vendors. Some additional details are also provided in U.S. Pat. No. 5,033,915 and U.S. Pat. No. 3,912,469, both of which discuss low pressure drop cyclones for other purposes, and both which are incorporated by reference.

OTHER FCC REACTOR/REGENERATOR CONDITIONS

Conventional conditions may be used.

Typical riser cracking reaction conditions include catalyst/oil ratios of 0.5:1 to 15:1 and preferably 3:1 to 8:1, and a catalyst contact time of 0.1 to 50 seconds, and preferably 0.5 to 5 seconds, and most preferably about 0.75 to 2 seconds, and riser top temperatures of 900° to about 1050° F.

Conventional stripping conditions, and conventional regeneration conditions may be used, whether swirl, cross-flow or high efficiency regenerators are used. The process of the present invention will usually allow somewhat lower air rates to be used in the primary regenerator vessel, because a significant amount of regeneration of catalyst will have been accomplished in the auxiliary regenerator.

CO COMBUSTION PROMOTER

Use of a CO combustion promoter in the regenerator or combustion zone is not essential for the practice of the present invention, however, it is preferred. These materials are well-known.

U.S. Pat. No. 4,072,600 and U.S. Pat. No. 4,235,754, incorporated by reference, disclose operation of an FCC regenerator with minute quantities of a CO combustion promoter. From 0.01 to 100 ppm Pt metal or enough other metal to give the same CO oxidation may be used with good results. Very good results are obtained with as little as 0.1 to 10 wt. ppm platinum present on the catalyst in the unit.

The process and apparatus of the present invention will allow existing regenerators to burn more coke from catalyst without increasing dust emissions, especially so in the case of bubbling dense bed regenerators.

Multi-stage regeneration of spent FCC catalyst will reduce hydrothermal deactivation of the catalyst, which will spend only a short time in the steam laden atmosphere of the auxiliary regenerator where hydrogen rich fast coke is burned in the presence of entrained stripping steam. Not only will the residence time be short, but the catalyst in the auxiliary regenerator will be at a relatively low temperature. Completion of regeneration in the drier atmosphere of the primary regenerator will reduce hydrothermal deactivation of the catalyst, as compared to single stage regeneration.

We claim:

1. A process for the fluidized catalytic cracking of a feed to lighter products, and multi-stage regeneration of catalyst in a fast fluidized bed auxiliary regenerator and a fast fluidized bed coke combustor, comprising:

cracking said feed in a vertical riser reactor having an inlet in a lower portion thereof for said feed and for a stream of regenerated cracking catalyst from a bubbling, dense phase fluidized bed of catalyst in a primary catalyst regenerator vessel, said reactor having an outlet in an upper portion thereof for discharging a mixture of spent cracking catalyst and cracked products into a reactor vessel;

separating, in said reactor vessel, cracked vapor products from spent catalyst discharged from said riser reactor to produce a cracked vapor product stream which is removed and a spent catalyst stream;

stripping said spent catalyst stream in a catalyst stripping means having an inlet for spent catalyst from said reactor vessel, an inlet for stripping gas in a lower portion, and an outlet in a lower portion for stripped catalyst;

transferring stripped catalyst from said stripping means to an auxiliary regenerator vessel;

turbulent or fast fluidized bed regeneration of said stripped catalyst from said stripping means by contact with an oxygen containing regeneration gas in an auxiliary regenerator vessel external to, and along side of, said primary regenerator vessel, said auxiliary regenerator having:

an inlet for stripped catalyst:

an inlet in a lower portion for regeneration gas; and an outlet in an upper portion thereof for partially regenerated catalyst and flue gas; and said primary regenerator vessel having:

a fast fluidized bed coke combustor having an inlet for spent catalyst and an inlet for regeneration gas;

a dilute phase transport riser in an upper portion of said coke combustor for transferring a dilute phase mixture of catalyst and flue gas up from said coke combustor to a riser outlet at a top portion of said transport riser; and a regenerator vessel for holding a dense bed of regenerated catalyst receiving catalyst and flue gas discharged from said transport riser, and having in a lower portion of said vessel a regenerated catalyst outlet for transfer of regenerated catalyst to said cracking reactor;

transferring said partially regenerated catalyst and flue gas from said auxiliary regenerator to said coke combustor via a transfer line having an inlet connective with said auxiliary regenerator outlet and a horizontal outlet in said coke combustor connective with at least one auxiliary cyclone;

cyclonically separating in said auxiliary cyclone at least 85% of said partially regenerated catalyst from flue gas in said coke combustor, said auxiliary cyclone having:

a tangential inlet horn connective with said horizontal outlet of said transfer line;

a vertical vapor outlet extending up from said cyclone toward said dilute phase transport riser;

a vertical solids outlet dipleg extending down into said coke combustor; and discharging down into said coke combustor a solids rich stream of partially regenerated catalyst via said dipleg outlet and discharging up toward an inlet of said transport riser a flue gas rich dilute phase via said cyclone vapor outlet;

fast fluidized bed regeneration of said partially regenerated catalyst in said coke combustor;

combining in said dilute phase transport riser all catalyst and all flue gas discharged from said coke combustor, and discharging from said transport riser cyclone outlet said combined stream into said primary regenerator vessel and separating said discharged combined stream to produce a flue gas stream which is withdrawn from said vessel and a regenerated catalyst stream which is returned to said cracking reactor.

2. The process of claim 1 wherein from 10 to 90 wt. % of the coke is removed in said auxiliary regenerator and the remainder is removed in said coke combustor and dilute phase transport riser.

3. The process of claim 1 wherein from 20 to 85 wt. % of the coke is removed in said auxiliary regenerator and the remainder is removed in said coke combustor and dilute phase transport riser.

4. The process of claim 1 wherein from 25 to 75 wt. % of the coke is removed in said auxiliary regenerator and the remainder is removed in said coke combustor and dilute phase transport riser.

5. The process of claim 1 wherein said auxiliary cyclone recovers from 90 to 97 wt. % of catalyst.

6. The process of claim 1 wherein said auxiliary cyclone recovers from 90 to 95 wt. % of catalyst.

* * * * *